US006969018B2

(12) United States Patent
Gimenez Ibanez et al.

(10) Patent No.: US 6,969,018 B2
(45) Date of Patent: Nov. 29, 2005

(54) SANITARY SHREDDER

(75) Inventors: Santiago Gimenez Ibanez, Alicante (ES); Jean-Claude Pollet, Vaux sur Seine (FR); Juan José Perez Salas, Alicante (ES)

(73) Assignee: Societe Etex de Recherches Techniques, Vernouillet (FR)

( * ) Notice: Subject to any disclaimer, the term of this patent is extended or adjusted under 35 U.S.C. 154(b) by 0 days.

(21) Appl. No.: 10/332,813

(22) PCT Filed: Jul. 24, 2001

(86) PCT No.: PCT/FR01/02414

§ 371 (c)(1),
(2), (4) Date: Jan. 13, 2003

(87) PCT Pub. No.: WO02/08610

PCT Pub. Date: Jan. 31, 2002

(65) Prior Publication Data

US 2004/0035961 A1 Feb. 26, 2004

(30) Foreign Application Priority Data

Jul. 25, 2000 (FR) ..... 00 09709

(51) Int. Cl.[7] ..... B02C 13/00

(52) U.S. Cl. ..... 241/185.6; 241/46.01; 241/46.017; 241/46.06; 241/46.08; 241/46.11; 415/121.1

(58) Field of Search ..... 415/121.1, 204, 415/206; 241/46.01, 46.017, 46.06, 46.08, 241/46.11, 185.6

(56) References Cited

U.S. PATENT DOCUMENTS

| | | | | |
|---|---|---|---|---|
| 3,228,036 A | * | 1/1966 | Gast et al. | 4/320 |
| 3,446,151 A | | 5/1969 | Andersson | |
| 3,560,106 A | * | 2/1971 | Sahlstrom | 415/204 |
| 3,707,334 A | | 12/1972 | Ohlsson et al. | |
| 4,402,648 A | * | 9/1983 | Kretschmer | 415/121.1 |
| 4,640,666 A | * | 2/1987 | Sodergard | 415/121.1 |

* cited by examiner

*Primary Examiner*—Derris H. Banks
(74) *Attorney, Agent, or Firm*—Young & Thompson

(57) ABSTRACT

A sanitary shredder includes at least a channel feeding water into a caisson (1), an electric motor whereof the axis has at its end a rotor pump (5) with blades (6), and shredding elements opposite the shredding chamber (3) provided with an inlet. The front surface (5*a*) of the rotor (5) is substantially planar and comprises a plurality of passages for water arranged substantially radially and emerging on the circumference of the rotor (5), each passage of the rotor (5) is extended by a channel delimited by the helical blades (6), the rotor (5) is housed in the pump body (8), its front surface (5*a*) being substantially in the plane of the pump body opening, shredding members (9) being arranged in axial projection relative to said front surface (5*a*).

20 Claims, 6 Drawing Sheets

SANITARY SHREDDER

BACKGROUND OF THE INVENTION

The present invention relates to a sanitary comminutor for an installation for handling waste water and solid waste, of the type comprising a tank receiving the water and an electric motor whose axle has at one end a rotary pump with blades and comminuting means facing a shredding chamber defined between the bottom of the tank and a peripheral wall provided with an inlet opening.

These sanitary comminutors are generally disposed behind toilet bowls. They can also receive waste water from other sanitary apparatus. They can moreover be enclosed within a technical partition.

Certain sanitary comminutors comprise a blade for shredding solid materials mounted at the end of a motor axle near the outlet of the toilet bowl. Only the water and solid material sufficiently comminuted pass through the holes of a cylindrical drainer toward a reservoir to be sucked up by a pump located in the bottom of the reservoir and mounted at the other end of the motor.

This type of apparatus has a certain number of drawbacks: the fibrous products such as sanitary napkins which are difficult to comminute have the tendency to accumulate within the strainer, which can end by blocking the apparatus. It is thus necessary to proceed to disassembly of the apparatus to restore it to operation.

There are also known shredding pumps in which the comminution system is integrated in the pump. In a first case, the shredding system is constituted by several cuttings blades mounted on the rotor, within the centrifugal pump. This latter has an axial inlet of a relatively reduced diameter to operate correctly. It happens sometimes that certain solid waste such as hand towels or sanitary napkins thrown into the toilet bowl remain blocked at the inlet of the pump and wrap around the rotor, which also ends in blocking the latter.

In another case, according to the patent DE 4 128 281, the comminuting apparatus has a blade and a counter blade disposed at the inlet of the pump, one being driven in rotation by the rotor of the pump and the other being fixed on the periphery to act in the manner of scissors.

This device however has the drawback of causing the noise of friction of the blades which is troublesome to the user, as well as the risk of blocking in the case of accidental penetration by hard objects.

SUMMARY OF THE INVENTION

So as to solve these problems, there should be a sanitary comminutor in which blocking of the pump is avoided, as well as the accumulation of solid waste, the blockage of the pump motor, whilst reducing the emission of noise during use.

To this end, the present invention has for its object a sanitary comminutor for an installation for handling waste water and solid waste, of the type comprising at least one channel for water inlet into a tank, an electric motor whose axle has at one end a rotary pump with blades and comminuting means facing a shredding chamber provided with an inlet opening, characterized in that the front surface of the rotor is substantially flat and comprises a plurality of passages for water, disposed substantially radially and opening about the circumference of the rotor, and in that each passage of the rotor is prolonged by a channel delimited by helicoidal blades, said rotor being disposed in the body of the pump such that its front surface will be at least substantially in the plane of the opening of the body of the pump, shredding means being disposed projecting axially relative to said front surface.

The shredding members are completed by a circular cutting blade, disposed in the plane of the opening of the body, and which defines with the front surface of the rotor the inlet opening of the pump.

Thus, preferably, the solid waste entrained by the movement of the water sucked in by the pump arrives at the front surface of the rotor where it is subjected to a cutting and/or shredding by the shredding members, whilst being both repelled by the motor with a turbulent movement because of the successive shocks of the projecting shredding members, and sucked in by the overall movement of the water. This turbulent movement is caused by the rotor of the helico-centrifugal type whose blades of helicoidal shape expel the water both toward the periphery of the rotor, because of centrifugal force, and toward the rear portion of the rotor, because of the inclination of the blades relative to an axial plane. The centrifugal force exerted by the rotor drives the residues toward the external cutting blade.

The front portion of the rotor is thus closed except for the passage or passages provided on the front surface and which, in an elongated straight or curved shape and disposed substantially radially, thus open about the periphery of the front surface of the rotor. The width of these passages lies within a range of 2 to 15 mm, the width of the passages being preferably constant or increasing from the center of the rotor toward the outside of the rotor.

Because of the limited width of the passages, the latter play the role of a filter to the extent that they block the intake of the pump to pieces of solid waste that are too large. The latter can enter only partially, and hence slide toward the exterior of the rotor under the influence of centrifugal force and of the water and are thus subjected to the action of a circular blade which separates the blocked portions at the exterior of the rotor from those which are partially introduced.

The shredding members are disposed axially projecting by 1 to 10 mm on the front surface of the rotor. These shredding members are made of a hard material, resistant to wear, such as metal for example, and are dimensioned and shaped so as to cut and/or shred the solid waste without retaining it. The shredding members can be of substantially conical shape, straight or inclined or preferably be flat either with saw teeth or with cutting blades, whilst the attack space is sufficiently inclined to avoid retaining and driving in rotation the fibrous substances.

The shredding members can be provided on an insert on which the rotor is overmolded or else said insert, such as a metal plate, is connected to the front surface of the rotor, the metal plate being cut out in a way to leave the passages of the rotor free when it is applied to the front surface of said rotor. These shredding members can also be fixed in compartments provided for this purpose on the front surface of the rotor.

As mentioned above, the opening of the pump body is provided with a circular cutting blade of an internal diameter slightly greater than the external diameter of the front surface of the rotor. Thus, during outward rejection of the solid waste that is too large to enter the passages defined in the front surface of the rotor, the blade present at the periphery of the rotor takes place in the process of cutting and shredding the waste because of the movement of the rotor relative to this blade.

So as to improve the phenomena of cutting and/or shredding, of self cleaning of the water passages and of the pumping described previously, there can also be provided shredding members on the back of the shredding chamber facing the central portion of the rotor and/or on the periphery of the opening of the pump body.

The shredding chamber is defined between the front surface of the rotor provided with shredding members, the front surface of the pump body, a bottom and a peripheral wall. This open peripheral wall is preferably substantially circular and has a shape imparting to the water and the solids a rotary movement toward the center of the rotor. In particular, said peripheral wall has an end in the form of a curved nose pointing in the direction of the axis of rotation of the rotor.

This nose is disposed adjacent the inlet of the water and the waste toward the shredding chamber, so as to cause the direction of the rotary flow to be substantially parallel and in the same direction as the flow entering the shredding chamber.

Preferably, the bottom of the shredding chamber comprises at least one protuberance which is disposed eccentrically relative to the axis of rotation of the rotor. This protuberance or these protuberances help in movement of the solids toward the rotor and the shredding members in the rotary movement generated in the shredding chamber.

According to a preferred embodiment of the invention, the motor and the pump as well as the electric members of the comminutor are enclosed in a compartment sealed against water in a casing in which it is disposed and which has a substantially parallelepipedal or cylindrical shape. Preferably, this sealed compartment is in the form of a small casing enclosable in the casing and disassembleable, said small casing being in particular adapted to the end of said casing whose bottom constitutes the bottom of the shredding chamber, the peripheral wall defining also the shredding chamber. The position of the small casing being offset relative to the axis of disconnection of the bowl, it is thus possible to remove, without careful disassembly of the comminutor, the small casing comprising the motor, the pump and the shredding means to repair it, by carrying out maintenance, or even effecting a standard exchange in the case of defect.

A portion of the casing located immediately behind the water closet bowl serves as a reserve chamber permitting rapidly gathering the water from the water closet.

The supply channel for used water can be in the form of an elbowed pipe passing through the casing and carrying the water and solid waste at the outlet of the toilet bowl toward the inlet opening of the shredding chamber. It is thus achieved that the solids will be immediately sucked into and contained in the shredding chamber, whilst the surplus water cannot be immediately contained in this latter but flows toward the reserve chamber provided in the casing and serving as a buffer reservoir. There is thus avoided the accumulation of solid waste in the casing. It can also be envisaged that the water supply channel is a system of partitions promoting the elimination of air bubbles before they reach the shredding chamber, which permits decreasing the noise generated. Furthermore, the pipe receiving the used water can be positioned directly on the pumping and comminuting member.

BRIEF DESCRIPTION OF THE DRAWINGS

The invention will now be described in greater detail, with examples of embodiment, with reference to the accompanying drawings, among which.

DESCRIPTION OF THE PREFERRED EMBODIMENTS

Figure 1:
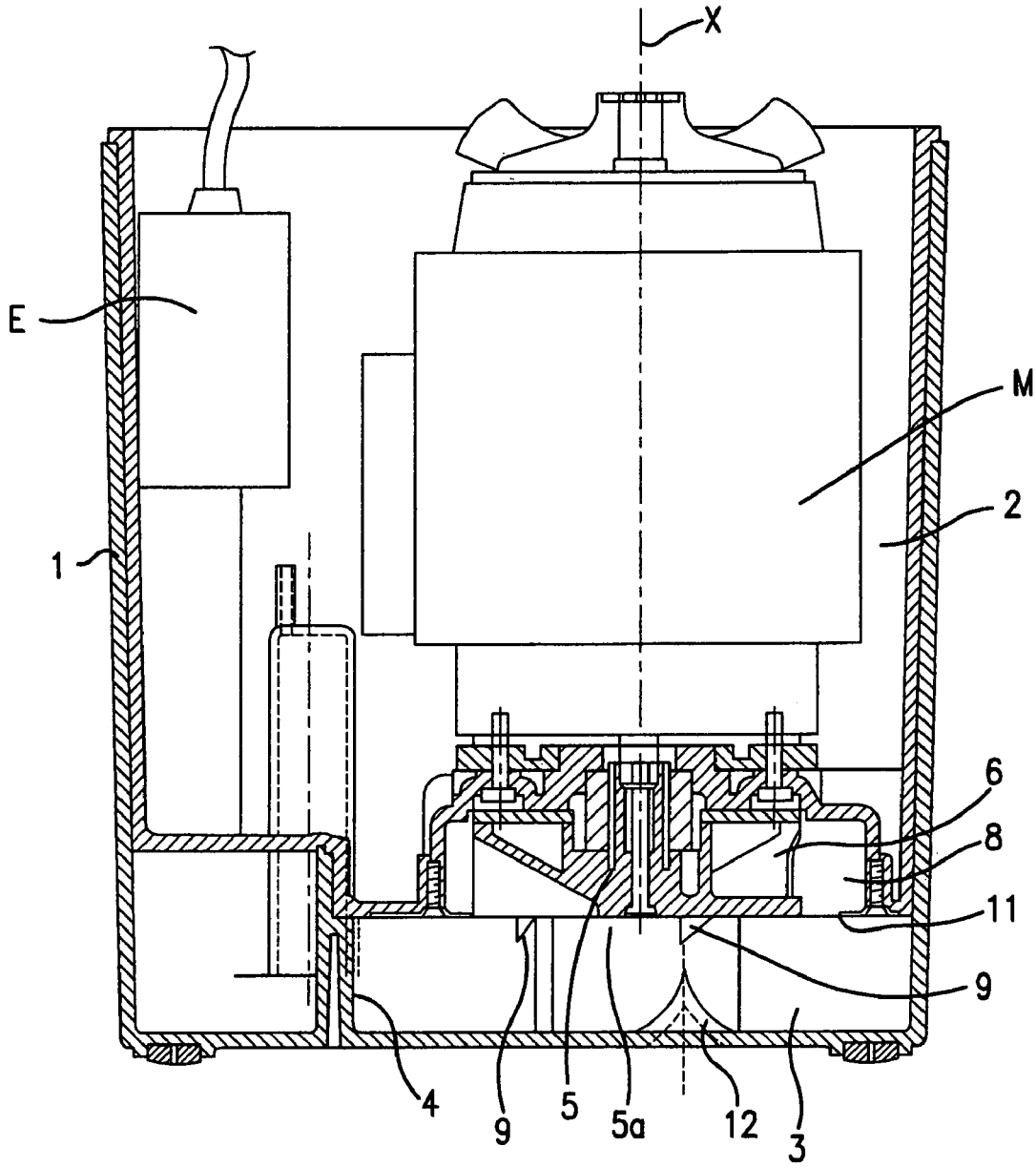
FIG. 1 shows a cross-sectional view of a comminutor according to the invention (without its covers)
Figure 2:
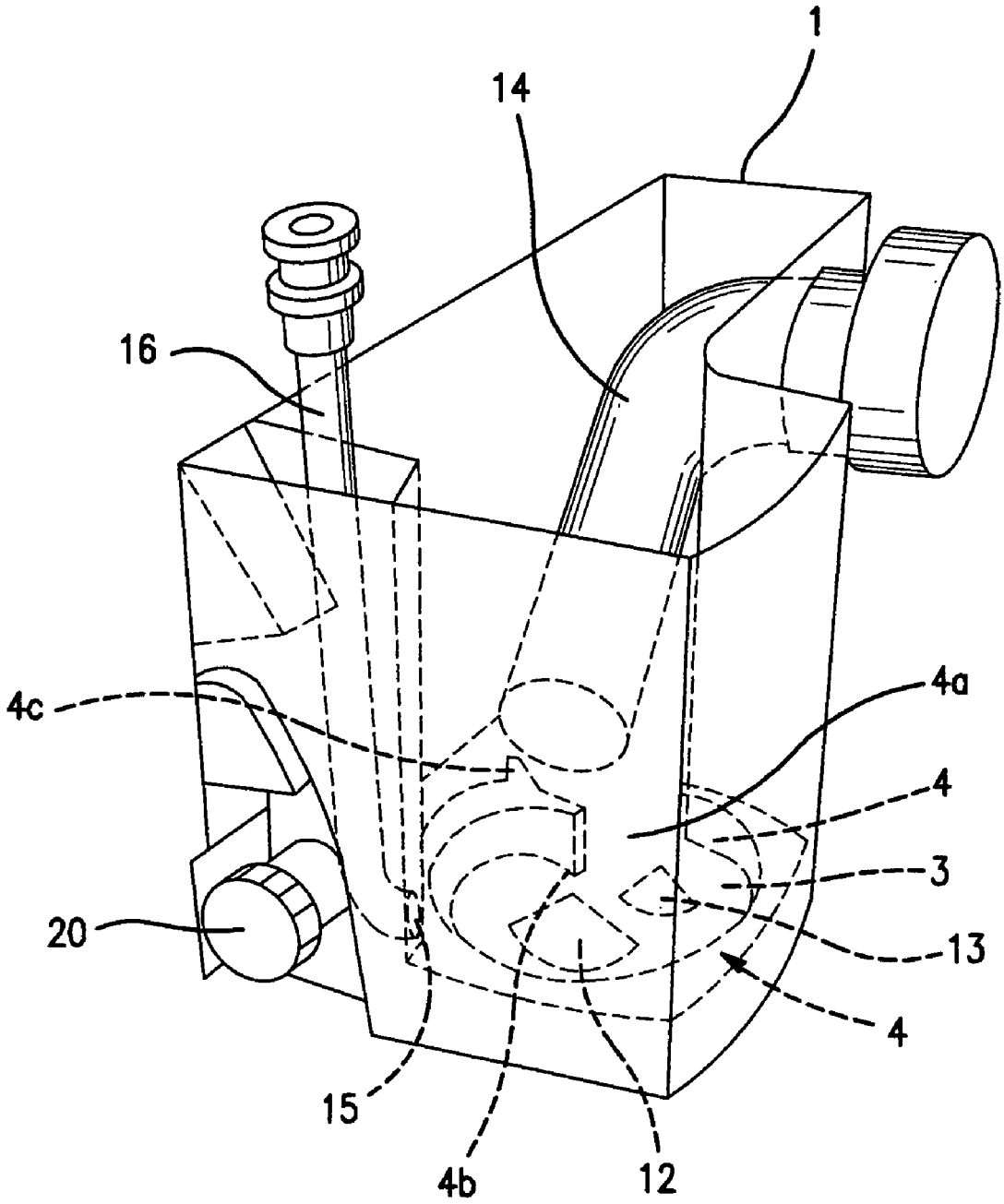
FIG. 2 is a perspective view of the casing of the comminutor shown in FIG. 1.
Figure 3:
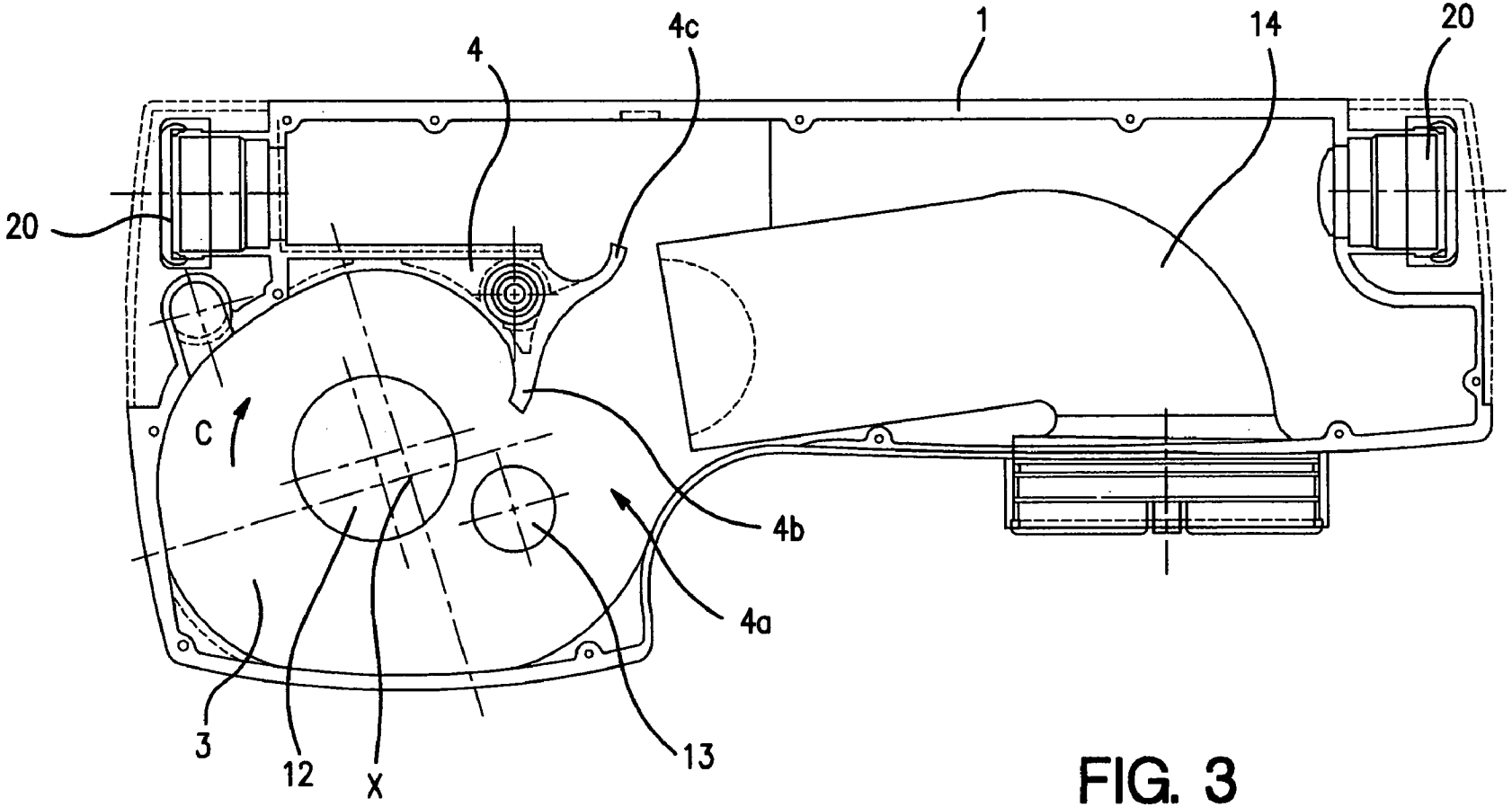
FIG. 3 is a plan view of the casing of the comminutor of FIG. 1.

As shown in FIGS. 1, 2 and 3, the sanitary comminutor for an installation for handling waste water and solid waste, according to a non-limiting embodiment of the invention, comprises a casing 1 receiving the water, a sealed compartment 2 enclosing electric devices E, as well as an electric motor M disposed vertically along an axis X.

This motor M drives at its lower end a rotor 5 with blades 6 of a handling pump. The rotor 5 is provided with shredding means disposed facing a shredding chamber 3 defined between the bottom of the casing 1 and a peripheral wall 4 provided with an inlet opening 4*a*.

As seen in FIGS. 1, 4, 5 and 6, the front surface 5*a* of the rotor 5 is substantially flat and comprises a plurality of passages 7 for water, disposed substantially radially and opening about the periphery of the rotor 5. Each passage 7 corresponds to a helicoidal blade 6 of the rotor 5.

Figure 5:
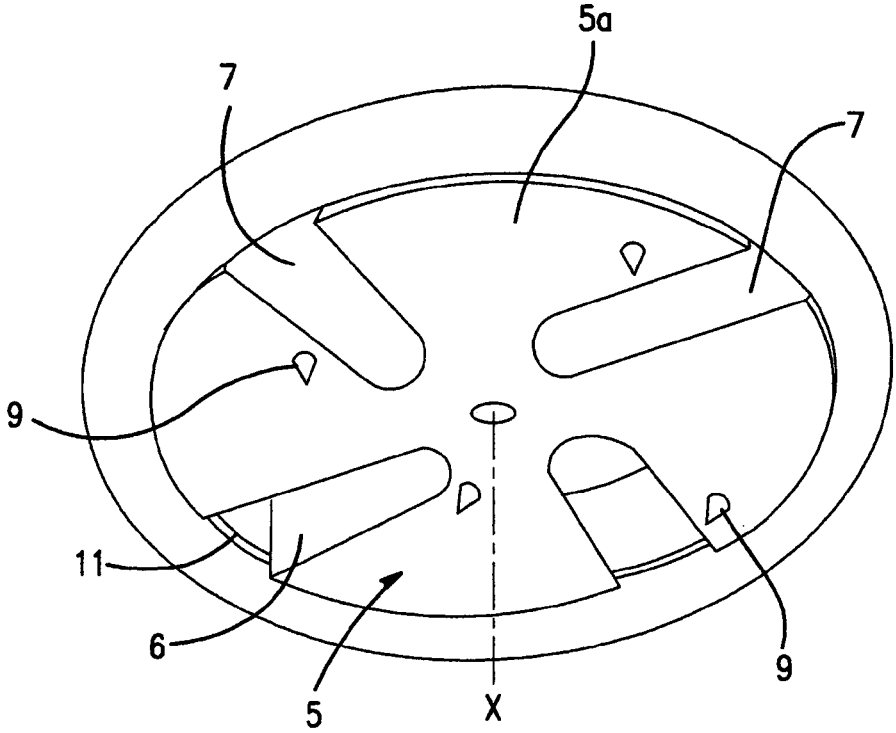
FIG. 5 is a front perspective view of the rotor according to FIG. 4 in the pump body.

The rotor 5 is disposed in the body 8 of the pump such that its front surface 5*a* will be substantially in the plane of the opening of the pump body 8 (compare FIG. 1) or projecting slightly relative to this plane (compare FIG. 5). The opening of the pump body 8 of an internal diameter slightly greater than the external diameter of the front portion 5*a* of the rotor 5 is preferably embodied in a circular cutting blade 11.

Figure 4:
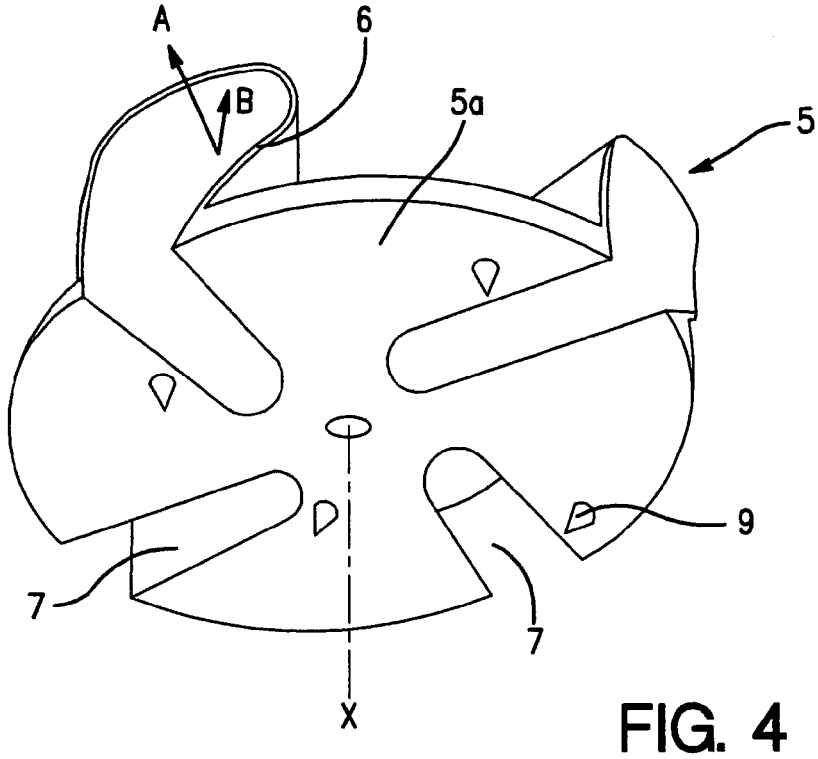
FIG. 4 is a front perspective view of a rotor of the comminutor according to the invention, provided with shredding members.

The shredding means are comprised by members 9, of an inclined conical shape in FIGS. 4 and 5, disposed projecting axially relative to said front surface 5*a*.

Figure 6:
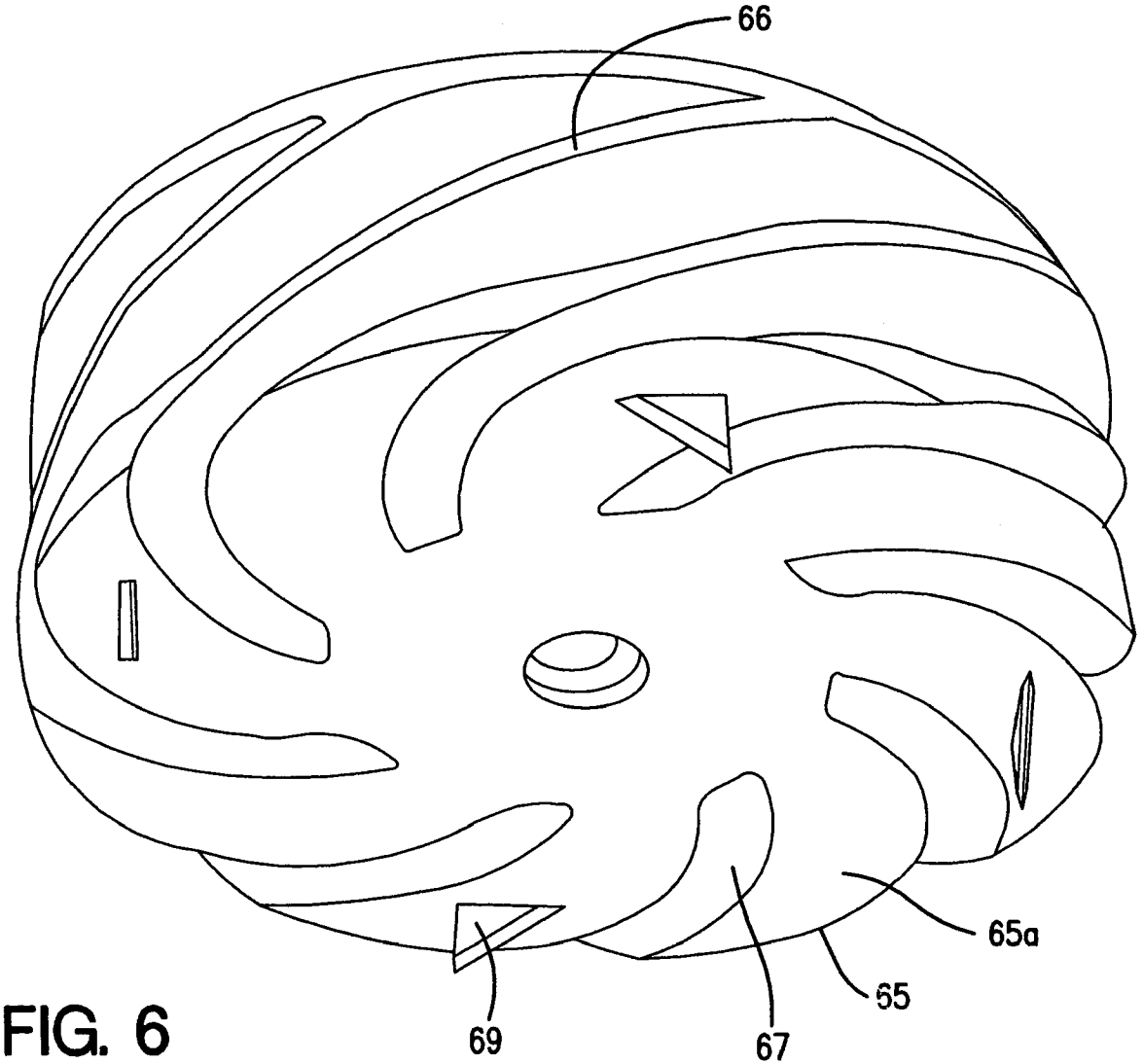
FIG. 6 is a side perspective view of another rotor according to the invention.
Figure 7:
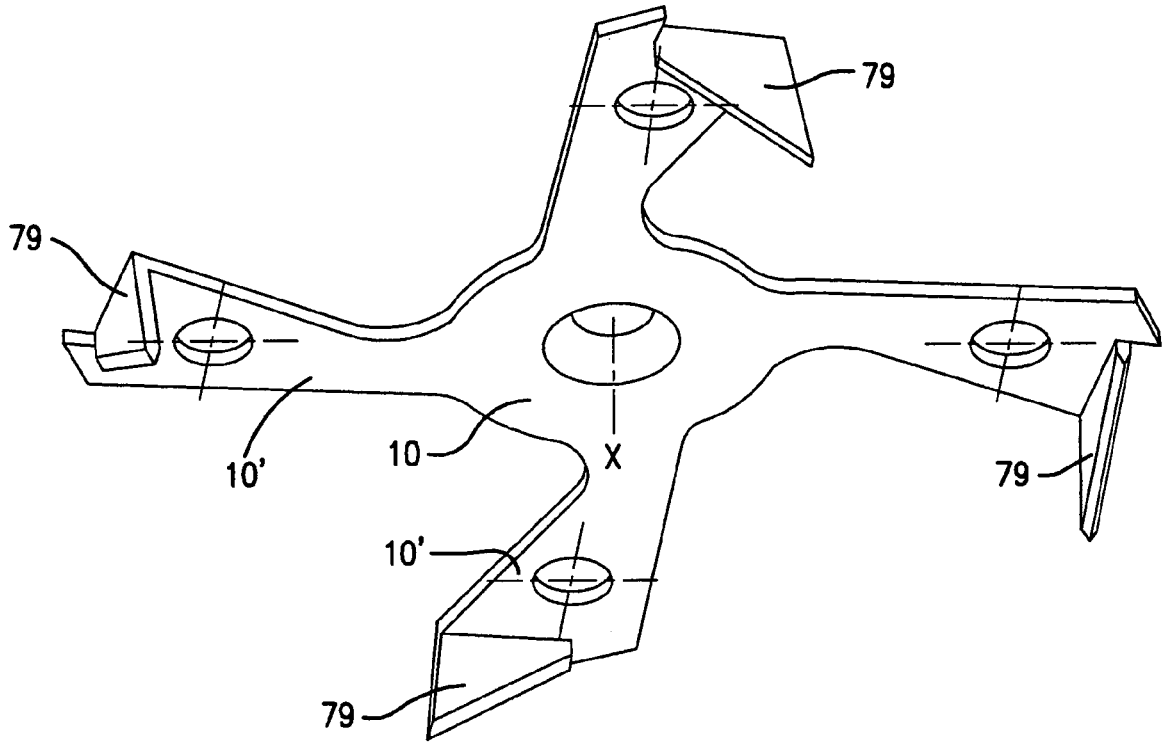
FIG. 7 is a perspective view from below of a shredding insert adapted to be included in a rotor.

In FIGS. 6 and 7 is shown a modified embodiment of the shredding members 69, 79. These latter are provided on a metallic insert 10 connected to the front surface 65*a* of the rotor 65 or the rotor can be overmolded on said insert 10. The insert is star-shaped whose legs 10' are disposed between the passages 67 for water. The end of each leg 10' is cut off to a point and this point is bent back to form a shredding member 69, 79. When the insert 10 is in place on the front surface 65*a* of the rotor 65, each point 69, 79 is disposed adjacent a passage 67.

The motor M and the pump as well as the electric devices E are disposed in a sealed compartment 2 provided in the form of a small casing (see FIG. 1) at the bottom of which is disposed the pump body 8 with the rotor 5. This small casing 2 is disposed in the casing 1 such that the rotor 5 will be facing the bottom of the casing 1 at the level of the shredding chamber 3 defined by the peripheral wall 4.

This peripheral wall 4 is substantially circular and thus delimits the shredding chamber 3, containing the rotary movement (in the direction of arrow C) of the water and the solids entering the chamber 3 (see FIG. 3).

The peripheral wall 4 has an end in the shape of a curved nose 4*b* pointing substantially in the direction of the axis of rotation X of the rotor 5. This particular shape of the end of the peripheral wall promotes the entry of waste into the shredding chamber 3 but also avoids the outlet of this waste, the redirection of the water induced by the nose 5*b* tending to bring the waste toward the center of the shredding chamber 3.

So as also to promote the movement of the waste in the chamber 3, the bottom of the casing 1 can comprise in the shredding chamber 3 projecting portions acting on the movement of the waste, so as to improve the shredding process. There can for example be used two protuberances, for example conical, 12, 13, eccentric relative to the axis of rotation X of the rotor 5. One of the protuberances 12 is located adjacent said axis X of the rotor whilst the other protuberance 13 is disposed substantially at the junction of the entering and rotary flows in the shredding chamber 3.

The small casing 2 being positioned preferably at one end of the casing 1, the evacuation of the waste water and the solid waste at the outlet of a toilet bowl for example does not face the shredding chamber 3. To avoid the accumulation of floating solids in the buffer portion of the casing, there is thus used a water inlet channel, for example an elbowed channel 14, which brings the water and the solid waste to the outlet of evacuation toward the opening 4*a* of the shredding chamber 3.

Preferably, the end of the wall 4 also has a nose 4*c* in a direction substantially opposite that of the nose 4*b* such that at the outlet of the channel 14, this nose 4*c* and the nose 4*b* guide the solid waste toward the inlet 4*a* of the shredding chamber 3. The nose 4*c* also permits defining a non-turbulent region for detecting the height of water by a pressostat.

The solid waste entrained by the movement of the water sucked in by the pump arrives at the front surface of the rotor 5 where it is subjected to cutting and/or shredding by the shredding members 9, whilst being both repelled by the rotor with a turbulent movement because of successive shocks of the projecting shredding members 9, and sucked in by the overall movement of the water. This turbulent movement is caused by the rotor 5 of the helicocentrifugal type. The blades 6 of helicoidal shape drive the water both toward the periphery of the rotor 5 because of centrifugal force and toward the rear portion of the rotor 5 because of the inclination of the blades 6 relative to an axial plane.

The small casing 2 comprises an outlet 15 of the pump body 8 connectable by the outlet connector 15 to an evacuation conduit 16. This evacuation conduit 16 is prolonged preferably by a non-return valve secured to the delivery conduit.

Preferably, the casing 1 comprises branches 20 for other water and waste inlets such that it is connectable to other installations for handling waste water such as basins, bidets, showers, etc.

To promote the cooling of the motor in the case of intensive use, there can be provided a cap system surrounding the upper portion of the motor, provided with fins and channeling the airflow.

What is claimed is:

1. Sanitary comminutor for an installation for handling waste water and solid waste, comprising:

a tank with a water inlet channel (14) allowing water into the tank (1), an electric motor, located interior to the tank, with an axle having a first end, the axle first end connecting to a rotary pump with a rotor (5) having helicoidal blades (6), and comminuting means, the pump comprising a pump body housing the rotor, the pump body including a lower opening, a shredding chamber (3) facing the comminuting means and provided with an inlet opening (4*a*) in fluid communication with the water inlet channel of the tank, wherein, a front surface (5*a*) of the rotor (5) is substantially flat and comprises a plurality of passages (7) for water disposed substantially radially and opening about the circumference of the rotor (5), the comminuting means comprises shredding members (9) attached to a flat region of the front surface of the rotor, the shredding members disposed projecting axially relative to said front surface (5*a*), each passage (7) of the rotor (5) is prolonged by a channel delimited by the helicoidal blades (6), said rotor (5) is disposed in the body (8) of the pump such that the flat region of front surface (5*a*) is at least substantially in the plane of the lower opening of the pump body, the shredding members (9) are disposed projecting axially relative to said front surface (5*a*).

2. Comminutor according to claim 1, characterized in that the internal diameter of the opening of the pump body is substantially equal to the external diameter of the rotor (5).

3. Comminutor according to claim 2, characterized in that the opening of the pump body is defined by a circular cutting blade (11).

4. Comminutor according to claim 3, characterized in that the width of the passages (7) provided on the front surface of the rotor (5) is within a range of 2 to 15 mm, the width of the passages (7) being constant or increasing from the center of the rotor (5) toward the exterior of the rotor (5).

5. Comminutor according to claim 1, characterized in that the shredding members (9) are disposed projecting axially from 1 to 10 mm on the front surface (5*a*) of the rotor (5).

6. Comminutor according to claim 1, characterized in that the shredding members (9) are made of a hard material resistant to wear, the shredding members (9) being shaped and dimensioned so as to cut and/or shred the solid waste without retaining it.

7. Comminutor according to claim 6, characterized in that the shredding members (9) are of substantially conical, straight or inclined shape.

8. Comminutor according to claim 6, characterized in that the shredding members (9) are flat, either with saw teeth or with cutting edges.

9. Comminutor according to claim 6, characterized in that the shredding members (9) are provided on an insert on which the rotor (5) is overmolded.

10. Comminutor according to claim 6, characterized in that the shredding members (9) are provided on an insert (10) connected to the front surface (5*a*) of the rotor (5).

11. Comminutor according to claim 10, characterized in that the insert is a metal plate cutout to leave passages (7) free when affixed to the front surface (5*a*) of the rotor (5).

12. Comminutor according to claim 1, further comprising a peripheral wall (4) delimiting the shredding chamber (3), the peripheral wall being substantially circular and with a shape imparting to the water and solids a rotary movement toward the center of the rotor.

13. Comminutor according to claim 12, characterized in that said peripheral wall (4) has one end in the shape of a curved nose **(4*b*) pointing in the direction of the axis of rotation (X) of the rotor (5)**.

14. Comminutor according to claim 13, characterized in that the end of the wall (4) has a first nose **(4*c*) in a direction substantially opposite that of a second nose (4*b*)**.

15. Comminutor according to claim 1, characterized in that the bottom of the shredding chamber (3) has at least one protuberance (12, 13) that is eccentric relative to the axis of rotation (X) of the rotor (5).

16. Comminutor according to claim 1, characterized in that a channel (14) brings water and solid waste from the outlet of a toilet bowl toward the opening **(4*a*) of the shredding chamber (3)**.

17. Comminutor according to claim 1, characterized in that the motor (M) and the electrical devices (E) are enclosed in a compartment (2) sealed against water in the tank (1) in which the compartment is disposed.

18. Comminutor according to claim 17, characterized in that the sealed compartment (2) is in the form of a small casing receivable in the tank (1) at the end of said tank (1) and disasserableable, whose bottom constitutes the bottom of the shredding chamber, the peripheral wall (4) also defining the shredding chamber (3).

19. Comminutor according to claim 18, characterized in that the position of the small casing (2) used in the tank (1) of the comminutor is offset relative to the axis of connection of a toilet bowl.

20. Sanitary comminutor for an installation for handling waste water and solid waste, comprising:

a tank with a water inlet channel;

an electric motor, located interior to the tank, with an axle having a first end;

a rotary pump connected to the axle first end;

the pump having a pump body (8), a lower opening, and a rotor (5) with a front planar surface **(5*a*)** facing away from the electric motor;

the rotor (5) comprising a plurality of helicoidal blades (6) delimiting prolonged channels and defining prolonged water passages (7) extending from the front planar surface toward the electric motor, the water passages being disposed substantially radially and open on the front planar surface and open at a circumference of the rotor (5), the rotor (5) disposed in the pump body (8) with the front planar surface at least substantially in the plane of the lower opening of the pump body;

a shredding chamber (3) facing the comminuting means and in fluid communication with the water inlet channel of the tank; and comminuting means located on the front planar surface, the comminuting means comprising shredding members (9) disposed projecting axially from the front planar surface and extending axially into the shredding chamber.

* * * * *